US006607108B2

(12) United States Patent
Mydans

(10) Patent No.: US 6,607,108 B2
(45) Date of Patent: Aug. 19, 2003

(54) LOAD TRANSFER AND STABILIZATION SYSTEM FOR BACKPACKS

(75) Inventor: David S. Mydans, Seattle, WA (US)

(73) Assignee: Recreational Equipment, Inc., Kent, WA (US)

( * ) Notice: Subject to any disclaimer, the term of this patent is extended or adjusted under 35 U.S.C. 154(b) by 0 days.

(21) Appl. No.: 09/782,431

(22) Filed: Feb. 13, 2001

(65) Prior Publication Data

US 2002/0108982 A1 Aug. 15, 2002

(51) Int. Cl.[7] ..... A45F 3/04

(52) U.S. Cl. ..... 224/630; 224/631; 224/637; 224/638; 224/641; 224/643; 224/644; 224/907

(58) Field of Search ..... 224/630, 631, 224/637, 638, 641, 642, 643, 644, 262, 907

(56) References Cited

U.S. PATENT DOCUMENTS 2,008,201 A * 7/1935 Chute ..... 224/262
4,015,759 A * 4/1977 Dreissigacker et al. ..... 224/262
4,114,788 A * 9/1978 Zufich ..... 224/153
4,194,656 A * 3/1980 Zufich ..... 224/631
4,214,685 A * 7/1980 Pletz ..... 224/634
4,303,186 A * 12/1981 Ollinger, IV ..... 224/211
5,366,126 A * 11/1994 Dausien ..... 224/630
5,503,314 A * 4/1996 Fiscus ..... 224/262
5,553,759 A * 9/1996 McMaster et al. ..... 224/259
5,836,489 A * 11/1998 Swetish ..... 224/262
5,954,253 A * 9/1999 Swetish ..... 224/631
6,199,732 B1 * 3/2001 Swetish ..... 224/262
6,276,584 B1 * 8/2001 McLachlan ..... 224/262

* cited by examiner

*Primary Examiner*—Stephen K. Cronin
(74) *Attorney, Agent, or Firm*—Seed IP Law Group PLLC

(57) ABSTRACT

A backpack load transfer and stabilization system includes a roll control rod coupled to a hip belt for a backpack. The control rod is contained entirely within the hip belt and extends across the width of the hip belt. The control rod is coupled, in turn, to semi-rigid extension members which serve as the interface between the hip belt and the main backpack. The extension members transfer the load to locations on the hip belt corresponding to hip locations of the person wearing the backpack. The extension members are rotatably coupled to the main backpack and rigidly coupled to the roll control rod, such that when a person wearing the backpack hikes, and the person's hips move up and down, the combination of the roll control rod and interconnected extension sections compensate for the up-and-down movement of the hips to stabilize the load and prevent side-to-side swaying.

20 Claims, 11 Drawing Sheets

LOAD TRANSFER AND STABILIZATION SYSTEM FOR BACKPACKS

TECHNICAL FIELD

This invention relates to backpacks, and more particularly to load transfer and stabilization systems for backpacks.

BACKGROUND OF THE INVENTION

Backpacks have long been used to carry loads and materials of all types. To make the backpack loads easier to haul, improvements to backpacks have continually been made to increase their efficiency, functionality, and comfort.

To create a backpack that is easier and more comfortable to carry, hip belts were developed many years ago. Hip belts are intended to transfer a portion of the load from the shoulders to the hips of the person wearing the backpack. Numerous different types of hip belts have existed over the years.

One problem associated with traditional hip belts is that the weight of the pack tends to focus on the mid-point of the hip belt, which is aligned with the center of the back (i.e., the backbone) of the person wearing the pack. When the backpack weight focuses on the mid-point of the hip belt, it tends to sag toward the middle and the load is not effectively transferred to the hips of the person wearing the backpack. One potential solution of the problem of sagging toward the middle of the hip belt would be to create a rigid hip belt, which would create cantilevers running toward each hip area of the belt. This, however, would add weight and unnecessary rigidity to the hip belt, making the hip belt less comfortable.

Attempts have been made to transfer the backpack load to the hip belt at locations adjacent the hips of the person wearing the backpack. One example of such a system has been created by Dana Design. Certain Dana Design backpacks include fiberglass rods extending from the shoulder strap areas to locations on the hip belt corresponding to the hips of a person wearing the backpack. Such a fiberglass rod will be found on each side of the backpack. The fiberglass rods serve to transfer the load from the shoulder strap areas to the hip belt at locations proximate to the wearer's hips.

Still another problem with traditional backpack designs is that they fail to provide a solution for side-to-side stabilization of the load. Since at least a portion of the backpack is supported at the wearer's hips, when a person walks or hikes, lifting a foot necessarily involves lifting the corresponding hip. Each time a person's hip rises, the backpack tends to shift laterally, particularly at the top end of the backpack, toward the opposite side. This causes the load to sway from one side to another as the person walks or hikes, lifting and lowering sequentially each of the hips. As the backpack sways from side-to-side, the hip belt, rigidly attached to the backpack cargo compartment, moves up and down at each hip location. This becomes tiring and quite uncomfortable over time and results in additional wear and tear on the backpack.

In view of the foregoing, there is a need to develop a backpack load transfer and stabilization system that will effectively transfer a load to hip locations on the hip belt, compensate for up-and-down movement of a person's hips while carrying the backpack, and maintain stationary the attachment locations between the backpack and the hip belt to increase comfort for the backpack wearer.

OBJECTS AND SUMMARY OF THE INVENTION

A primary object of the invention is to provide an effective load transfer and stabilization system for backpacks.

Another object of the invention is to provide a load stabilization and transfer system for a backpack to transfer a portion of the load to the hips and compensate for the rise and fall of the hips of the person wearing the backpack.

Still another object of the invention is to provide a backpack load transfer and stabilization system that transfers the load to the hips, yet stabilizes the load by dynamic interaction between hip-supporting areas while the backpacker walks.

Another object of the invention is to provide a backpack load transfer and stabilization system which involves a resilient roll control rod attached to opposed generally triangularly shaped extension members which dynamically and interactively shift and transfer the load outwardly toward the hips, with the roll control rod causing the extension members to interact with each other to stabilize the load while a wearer walks with the backpack.

Yet another object of the invention is to provide a backpack load stabilization and transfer system that will support that load at stationary locations on a hip belt by providing a roll control rod attached to opposed extension members which interactively compensate for the side-to-side sway of the backpack as a person carrying the backpack walks.

Another object of the invention is to provide a backpack load transfer and stabilization system to transfer the backpack load from attachment locations interconnecting the backpack to the cargo compartment to extended locations on the hip belt corresponding to the wearer's hips.

Still another object of the invention is to provide a backpack load transfer and stabilization system to simultaneously transfer the weight of the backpack to locations on a hip belt corresponding to the wearer's hips and stabilize the side-to-side sway of the backpack as the wearer walks.

The foregoing objects of the invention are achieved by a backpack load transfer and stabilization system according to the present invention. The load transfer and stabilization system comprises a roll control rod, encased in a webbing pocket sewn into the hip belt, coupled to opposed semi-rigid extension members. The roll control rod forms an arc having an apex toward the top of the hip belt. The roll control rod is contained entirely within the hip belt. The pair of extension members or wings are operatively coupled to the ends of the roll control rod. These extension sections are coupled, in turn, to attachment locations interconnecting the cargo compartment of a backpack with the hip belt. The attachment locations allow for pivotal movement between the extension members rigidly coupled to the hip belt and the cargo compartment. The extension members transfer the load from the attachment location to locations farther out on the hip belt corresponding to the hips of the person wearing the backpack. The roll control rod interactively connects the extension members so that movement of one (which results from movement of the corresponding hip of the backpack wearer) results in a reactive movement of the other to stabilize the load when the wearer walks and moves his or her hips up and down.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

DETAILED DESCRIPTION OF THE INVENTION

Figure 1:
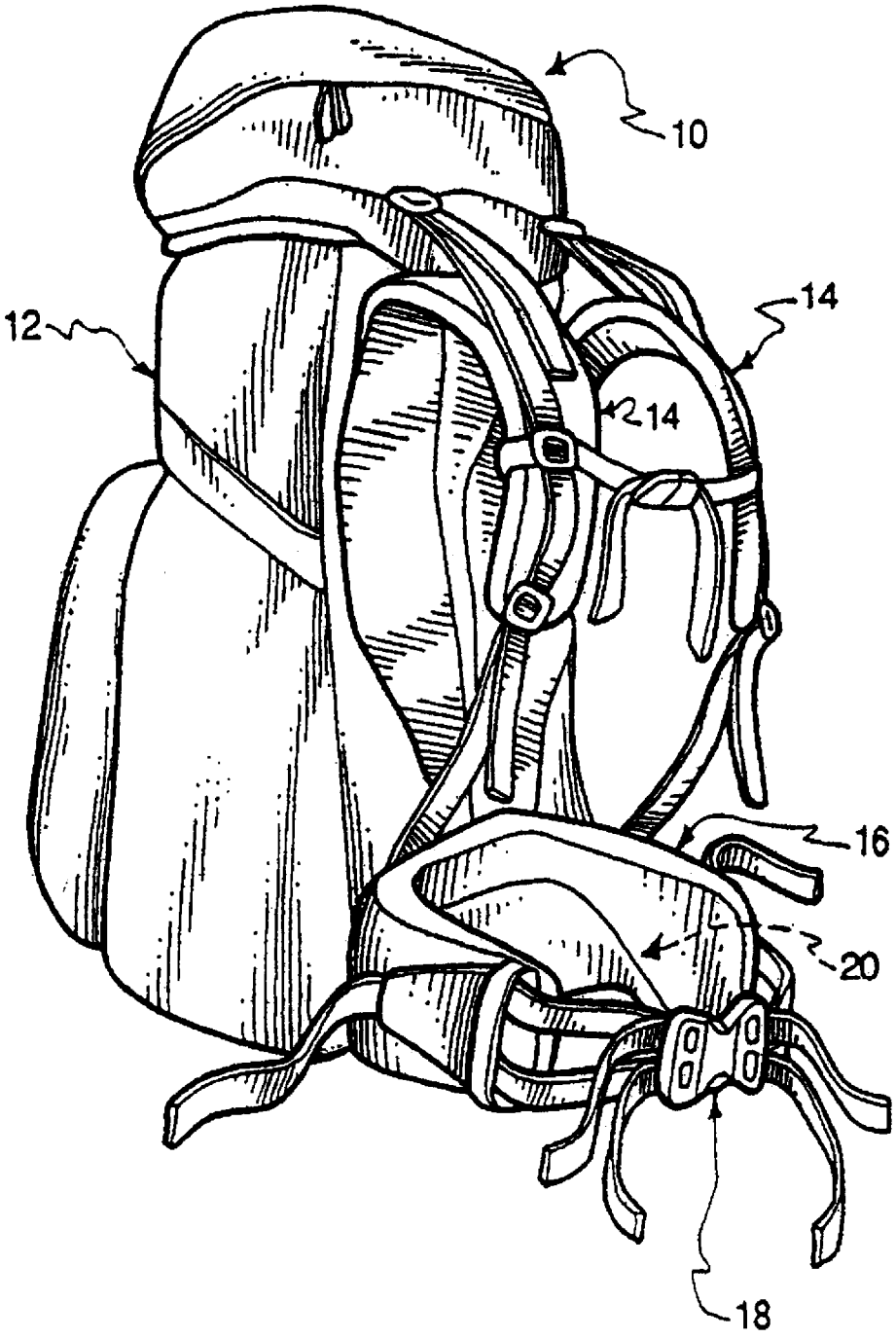
FIG. 1 is a rear perspective view of a conventional backpack apparatus incorporating a load transfer and stabilization system according to the present invention.

The present invention is intended for use in connection with a backpack apparatus 10, as shown in FIG. 1. While FIG. 1 shows a so-called internal frame backpack 10, it is to be understood that the present invention may be utilized with virtually any type of backpack apparatus where a hip belt is utilized.

A conventional backpack apparatus 10 includes, among other things, a main pack or payload or cargo compartment 12, shoulder straps 14, a hip belt 16, and a buckle 18 for the hip belt. Virtually all backpacks used for hiking, mountaineering, and the like include these conventional elements. The specific construction of conventional aspects of a backpack apparatus suitable for the present invention will be known to those skilled in the art.

Figure 5:
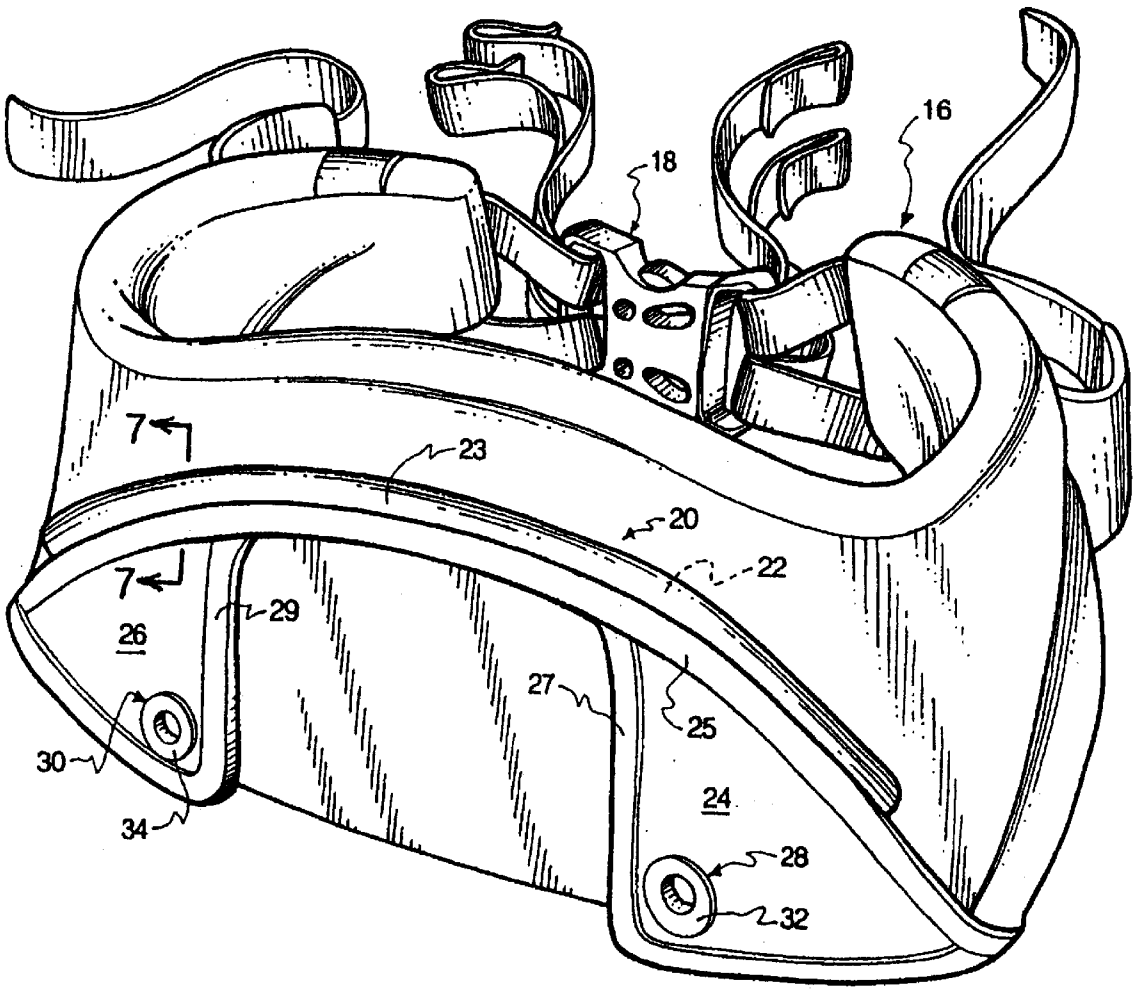
FIG. 5 is a front perspective view of a hip belt for a backpack incorporating a load transfer and stabilization system according to the present invention.
Figure 6:
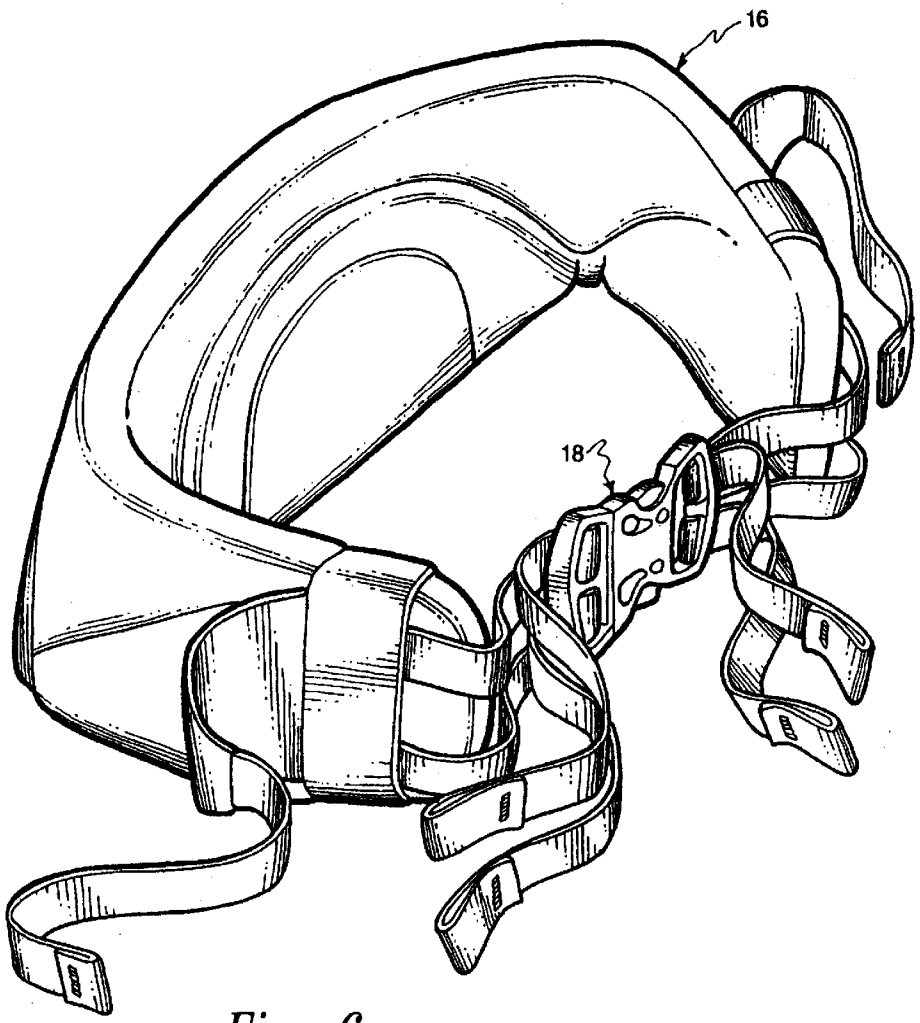
FIG. 6 is a rear perspective view of a hip belt for a backpack incorporating a load transfer and stabilization system of the present invention.

The present invention relates to load transfer and stabilization system 20 (FIG. 1) for backpacks 10. The load transfer and stabilization system 20 is to be utilized in connection with the hip belt 16 of the backpack apparatus 10. With reference to FIGS. 5 and 6, the load transfer and stabilization system 20 is integrally incorporated into the hip belt 16. The hip belt, having a height and a width, completely holds the load transfer and stabilization system. The system is more specifically incorporated into a side of the hip belt adjacent the cargo compartment 12 (FIG. 1) of the backpack apparatus 10. The portion of the hip belt 16 that comes in contact with the wearer's lumbar and hip area when wearing the backpack (FIG. 6) comprises a conventional foam pad over which a suitable material, such as nylon or another synthetic fabric, is secured. The inner lining or surface of the hip belt 16 may be made of spandura or other suitable material, and may include a gripping surface.

Figure 7:
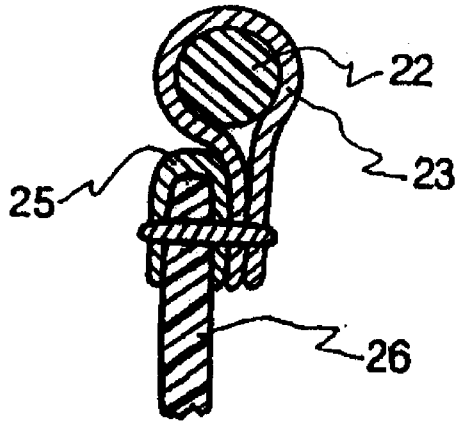
FIG. 7 is a sectional side view, taken along the lines 7—7 of FIG. 5, of the flexible, resilient roll control rod sewn into a pocket or webbing which is sewn, in turn, to a rigid lumbar plate to form a part of the load stabilization system according to the present invention.

With reference to FIG. 5, the roll control apparatus 20 comprises a flexible stabilizer in the form of a resilient rod 22, made preferably of delron or another suitable resilient material. The stabilizer or rod arcs upwardly to form an apex in close proximity to an upper edge of the hip belt. The ends of the rod 22 terminate below a middle line (relative to the top and bottom) of the hip belt. The rod 22 is held within a sheath of cloth material 23 sewn or otherwise secured to the outer surface of hip belt 16. While the rod 22 preferably comprises a circular cross-sectional shape, as shown in FIG. 7, it is to be understood that the term "rod" is intended to cover all cross-sectional shapes of resilient, rod-like members that may be used in connection with the present invention. The flexible rod 22 terminates at ends 22*a*, 22*b* (FIGS. 2A–2C, and 3–4), each of which is attached to respective wings or extension pieces 24, 26. A fabric sheath 23 (FIG. 7) is used to hold the rod 22 in position. A main fabric border 25 (FIG. 5) is sewn below the sheath 23 and interfaces between rod 22 and extension pieces 24, 26. While the flanged extension pieces may be made of any suitable rigid material, preferably a high density polyethylene or another suitable synthetic material is used. The flanged extension portions or wings 24, 26 are generally triangularly shaped. The extension pieces 24, 26*b* are secured to the hip belt by additional peripheral fabric pieces 27, 29, which ultimately join and are sewn or otherwise secured to the main fabric piece 25. Fabric pieces 27, 29 cover the edges of the rigid material comprising the flanged extension pieces 24, 26, which can be rough and capable of cutting anything it contacts—especially when bearing a load such as during backpacking.

As shown in FIGS. 2–5, the extension members 24, 26 further comprise fastening or mounting locations 28, 30, respectively. Fastening locations 28, 30 provide areas for attaching the flanged extension portions to the lower end of a backpack cargo compartment 12 (FIG. 1). In the embodiment of FIG. 5, grommets 32, 34 are secured to the extension members to define fastening locations 28, 34. Pins, bolts, rivets, or other fastening members (not shown) may be inserted through grommets 32, 34 and secured to the main compartment 12 of the backpack 10 to couple the hip bet 16 via extension pieces 24, 26, to the cargo compartment 12 of the backpack 10. The fasteners allow the extension members 24, 26 to articulate relative to mounting locations 36, 38.

Figure 4:
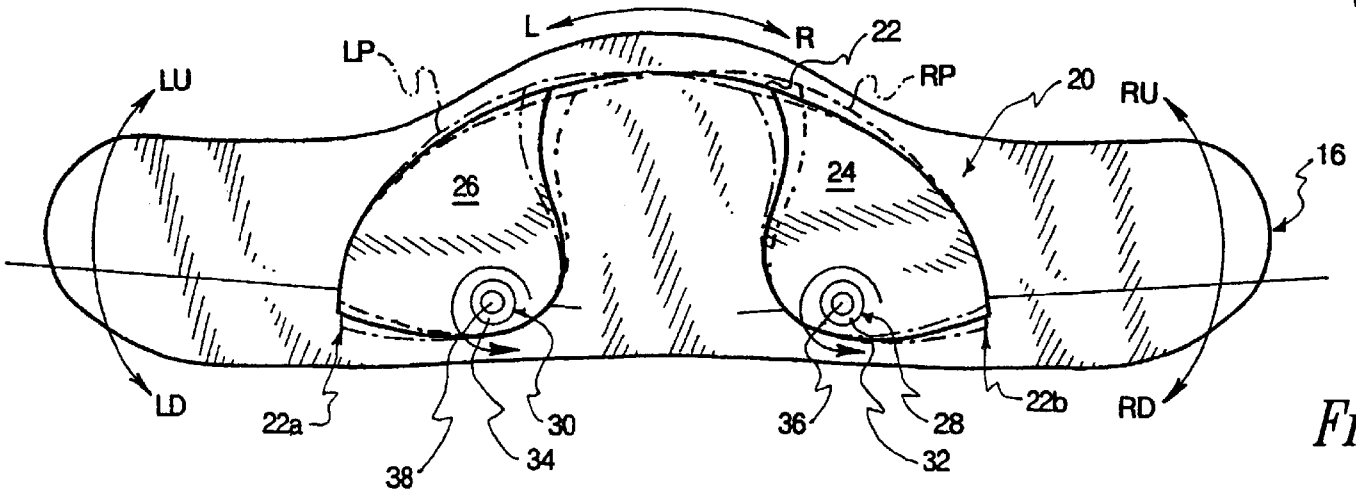
FIG. 4 is a front elevation view of a hip belt for a backpack showing the load transfer and stabilization system of the present invention as it moves between various load stabilization positions.

As shown in FIG. 4, when a person wears a backpack with the hip belt 16 secured around his or her waist and hips, moment arms are created between mounting location 36 and roll control rod end 22*b*, and between mounting location 38 and roll control rod end 22*a*. These lever arms work to transfer the load out further toward the extreme ends of the hip belt, to locations corresponding to the wearer's hips. When the wearer of the backpack walks, the right hip will move up (RU) and down (RD), and the left hip will move up (LU) and down (LD). As the right hip moves up, for example, to the position (RU), the end 22*b* of the roll control rod moves up and the roll control rod flexes to a skewed left position (LP), which results in the end 22*a* of the roll control rod moving down. Because the extension pieces 24, 26 are secured together via the roll control rod 22, they are interactive relative to one another. When one of the roll control rod ends 22*a*, 22*b* moves up or down, the other roll control rod end moves in an opposite direction. Where the entire roll control apparatus 20 is held within the hip belt (i.e., the upward arc of the roll control rod 20 does not extend beyond the height of the hip belt), the up-and-down motion for the hips is compensated for by the load transfer and stabilization system. The extension pieces 24, 26 dynamically and interactively move relative to one another about mounting locations 36, 38, while mounting locations 36, 38 remain relatively stationary. This results in a stabilized load, while achieving the benefits of a load transferred to the hips of the person wearing the backpack.

Figure 2A:
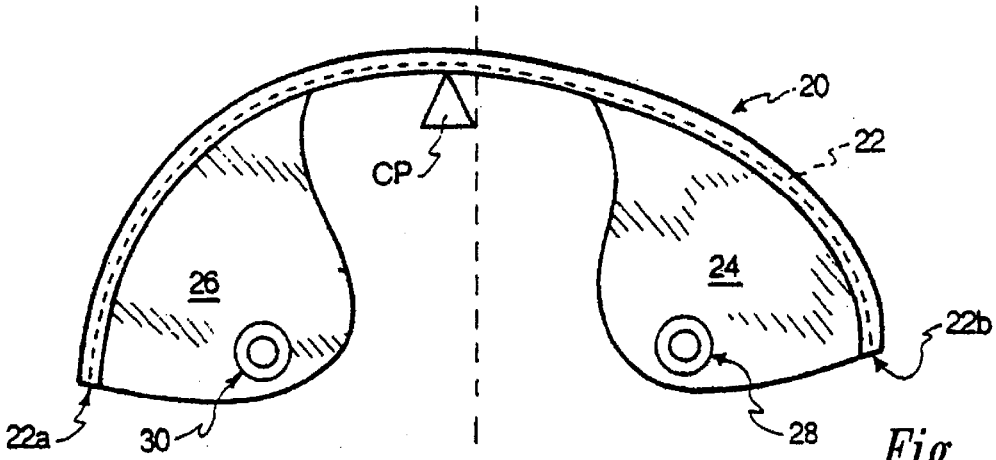
FIG. 2A is a front elevation view of a load transfer and stabilization system (without the hip belt) according to the present invention showing the configuration of the system when the backpack wearer lifts his or her right leg and hip.
Figure 2B:
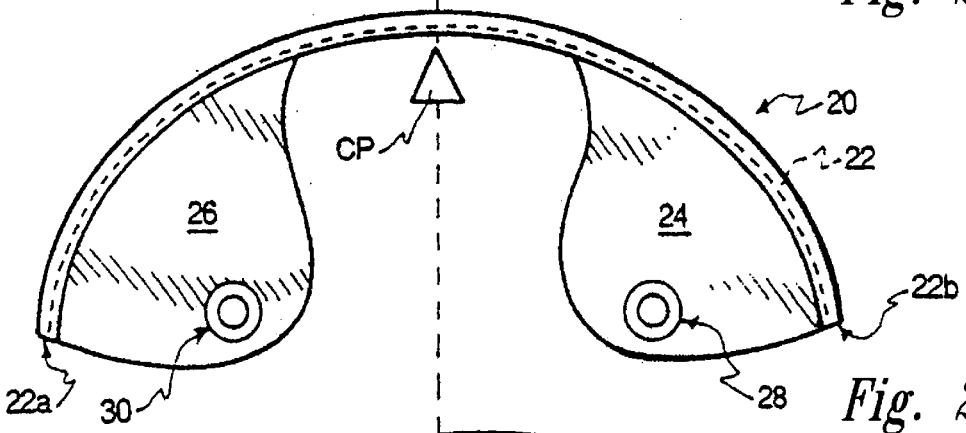
FIG. 2B is a front elevation view of a load transfer and stabilization system (without the hip belt) according to the present invention showing a stationary position of the system when neither of the hips of the backpack wearer is moving.
Figure 2C:
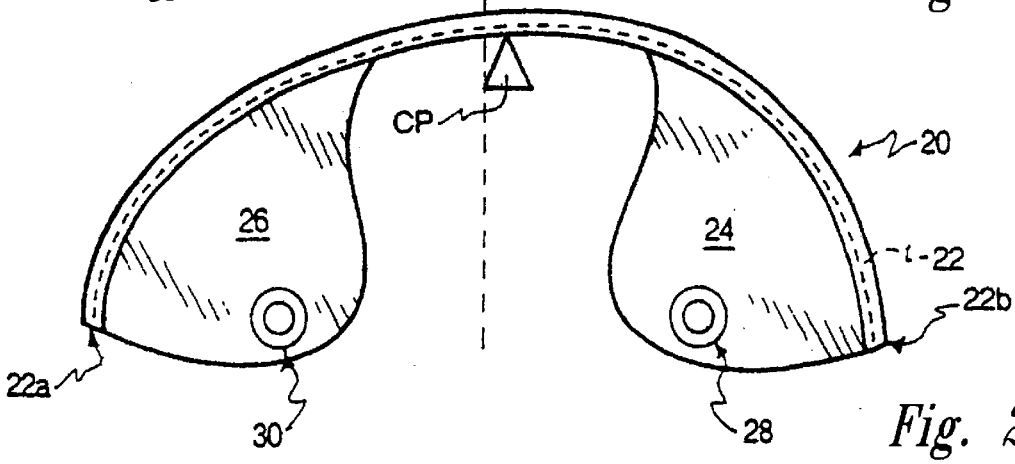
FIG. 2C is a front elevation view of a load transfer and stabilization system (without the hip belt) according to the present invention showing the configuration of the system when the backpack wearer lifts his or her left leg and hip.

With reference to FIGS. 2A–2C, the center point (CP) of the roll control rod and its changes, depending on movement of the wearer's hips, can be seen. In FIG. 2A, the person's right hip elevates at roll control rod end 22*b*, which shifts the center point (CP) toward the left relative to a neutral position (shown in FIG. 2B). In response, the opposed end 22*a* is lowered. Both of the extension members 24, 26 rotate counterclockwise relative to mounting locations 28, 30, respectively. The opposite occurs when the left hip is raised, which correspondingly raises roll control rod end 22*a*, lowers roll control rod 22*b*, and shifts the center point (CP) toward the right relative to the neutral center point (CP) position (shown in FIG. 2B). Extension pieces 24, 26 rotate clockwise relative to mounting locations 28, 30, respectively.

Figure 3:
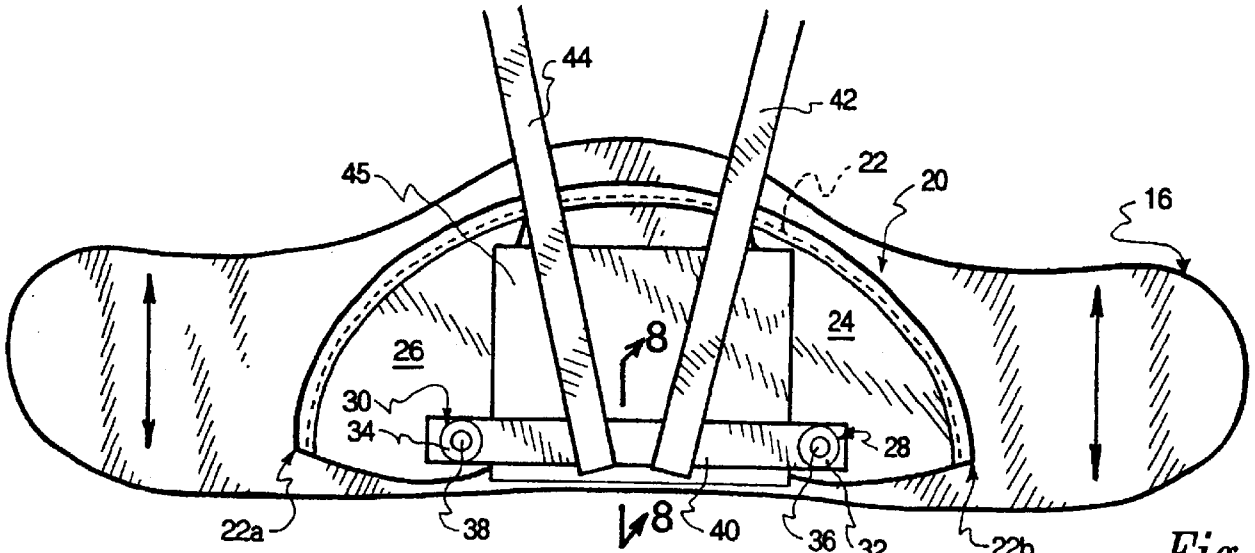
FIG. 3 is a front elevation view of a hip belt for a backpack with a load transfer and stabilization system with the backpack's vertical and transverse stays shown according to the present invention mounted thereto.
Figure 8:
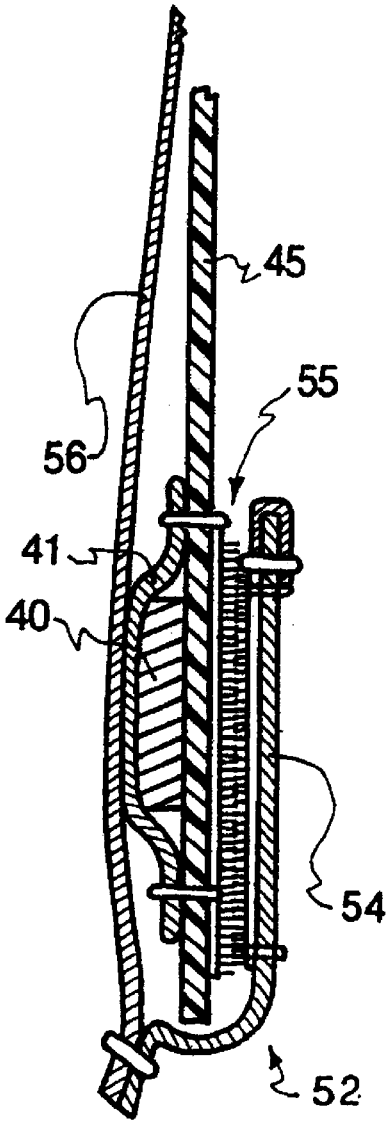
FIG. 8 is a sectional view, taken along line 8—8 of FIG. 3, of one preferred method of securing the various stay-lumbar plate structures to a backpack apparatus used in connection with the present invention.

With reference to FIGS. 3, 4, and 8, the hip belt 16, with the associated roll control apparatus 20, is attached to the cargo compartment 12 of the backpack apparatus 10 (FIG. 1) via mounting locations 28, 30, as discussed above. Mounting pins or other suitable fasteners 36, 38 extend through the grommets 32, 34 (FIG. 5) and ultimately through a horizontal crossbar 40 (FIG. 3) to interconnect the hip belt with the cargo compartment of the backpack. As shown in FIG. 8, the crossbar 40 is held in place by a piece of fabric 44 sewn to the lumbar plate 45, which is secured, in turn, to the cargo compartment 12 of the backpack apparatus 10 (FIG. 1). The lumbar plate 45 is preferably made of high density polyethylene, but other suitable semi-rigid material may be utilized. The horizontal crossbar 40 is also operatively coupled to lower ends of vertically oriented stays 42, 44 (which converge toward the bottom of hip belt 16 to form a V-shaped configuration) by fabric pieces (not shown in FIG. 3) sewn into the lumbar plate 45. The V-configured frame diverges toward the top of the backpack to correspond to the relatively wider shoulders of the backpack wearer and converges toward the bottom to correspond to the wearer's waist. The sizes (i.e., the cross-sectional dimensions and lengths of the stays) may vary to provide a custom fit. The stays are preferably made of 6061/T6 aircraft aluminum.

Although not shown in the drawings, a lumbar pad is intended to be utilized in connection with the hip belt. Unlike conventional lumbar pads, however, a lumbar pad may be installed between the hip belt 16 and the cargo compartment 12 when used with the present invention. A preferred lumbar pad may comprise of a single piece of material or layers of material, which can be selectively used by the wearer.

FIG. 8 shows the cross-sectional details of a fabric piece 41 sewn to the high-density polyethylene lumbar plate 45 to hold the transverse stay 40 in place at the bottom of the backpack cargo compartment. A lower flap 56 and an extension flap 54 integrally extend from the main backpack to secure the lumbar plate 45 to the backpack. A velcro fastener 55 holds the lumbar plate 45 in the proper location on the backpack. Fabric pieces (not shown) for the vertical stays 42, 44 secure the vertical stays in their V-shaped orientation directly to the high-density polyethylene lumbar plate 45. The stays can be removed from the pockets formed by the fabric pieces to be replaced by different stays for custom fitting purposes.

The stay-lumbar plate construction results in a unitary assembly comprising the transverse bar 40, the vertical stays 42, 44, and the lumbar plate 45. The purpose of this configuration is to ensure that the load is appropriately translated to the hip belt and the inventive load transfer and stabilization apparatus.

In operation, the present invention results in support of the main backpack or cargo compartment 12 at two locations on the hip belt—mounting locations 28 and 30. These are the only two areas where the hip belt is mounted to the cargo compartment. The triangular-shaped high density polyethylene extension sections or wings 24, 26 transfer the load further toward the extreme ends of the hip belt to a position closer to areas on the hip belt that correspond to the wearer's hips. In essence, a moment arm is created between mounting location 28 and end 22*b* of roll control rod 22, and between mounting location 30 and end 22*a* of the roll control rod 22. These moment arms transfer the load out from the mounting locations 28, 30 to the ends 22*a*, 22*b* of the roll control rod 22, which corresponds to the hips of the person wearing the backpack. The result is increased comfort for the wearer and a more stable load.

Utilization of the present invention results in a stabilized backpack load that accommodates for the rise and fall of a person's hips while hiking. FIGS. 2A–2C (described above) show a sequence of the load transfer and stabilization system and sequential positions of the roll control rod 22 and the attached extension pieces 24, 26 when a person wearing the backpack walks. The extension members 24, 26 rotate relative to mounting locations 28, 30, yet the vertical positions of mounting locations 28, 30 remain relatively stationary. This results in a more comfortable stable load.

Figure 9:
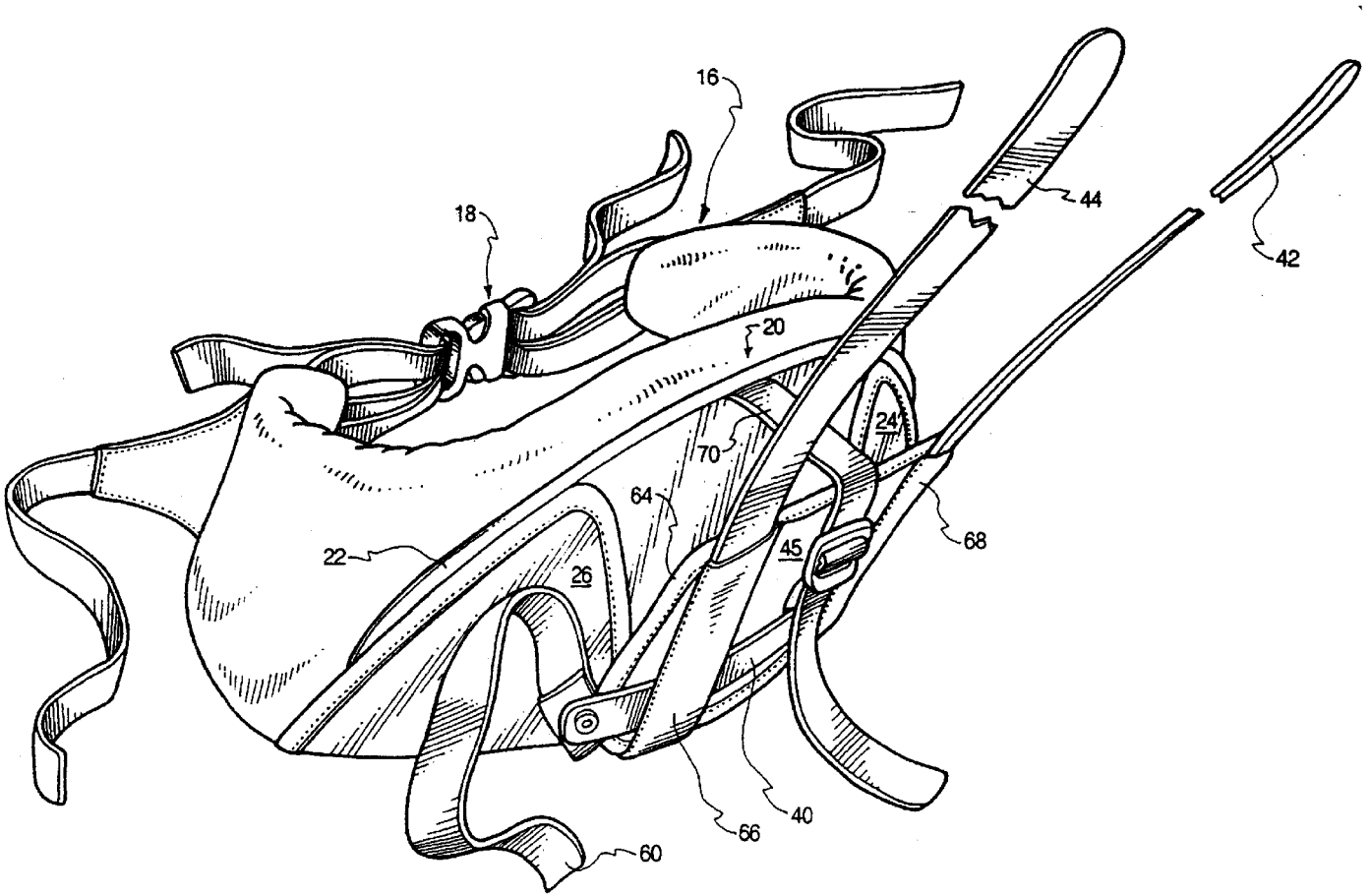
FIG. 9 is a perspective view of the backpack load transfer and stabilization system of FIG. 5, with additional features of the hip belt and load transfer and stabilization system shown.
Figure 10:
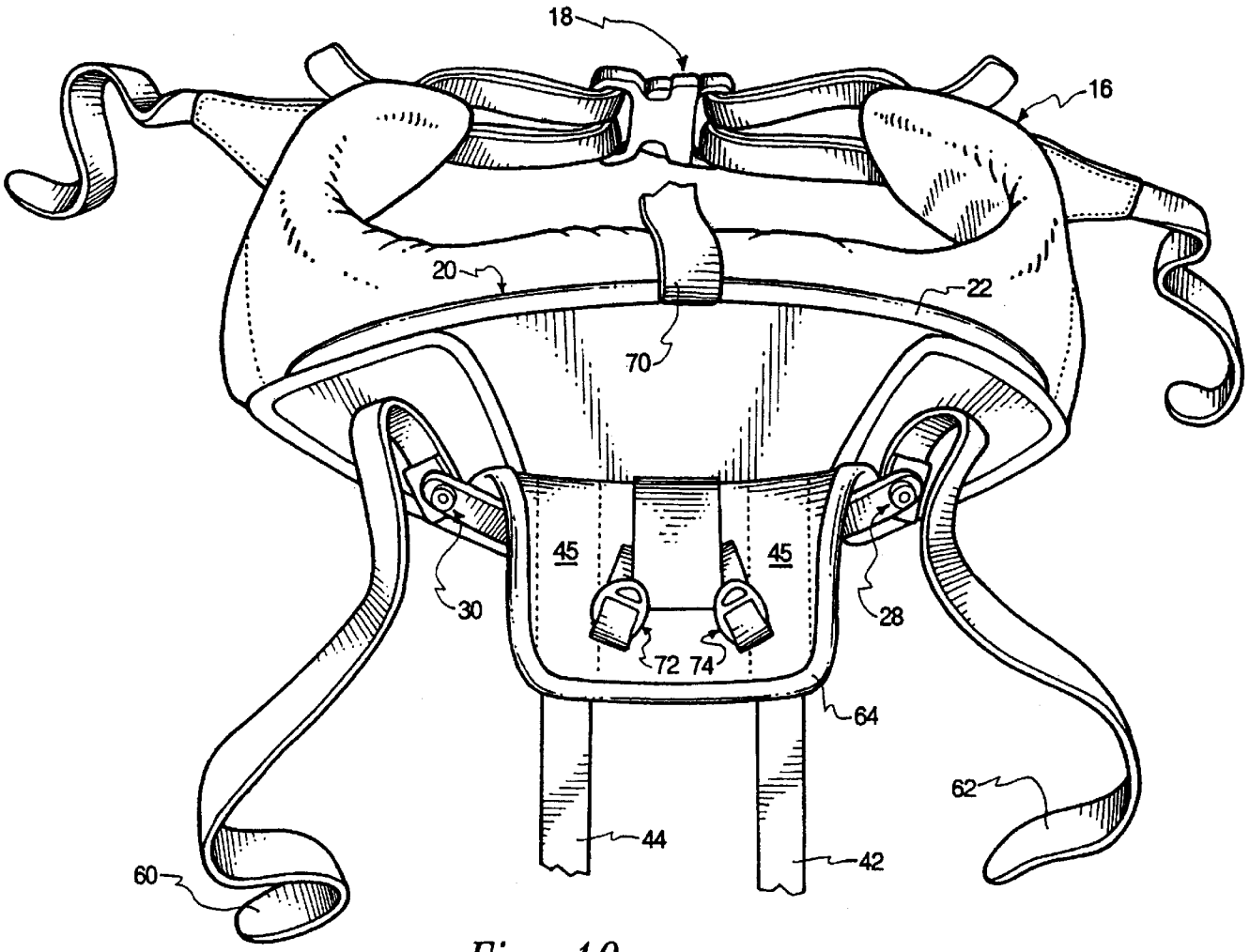
FIG. 10 is a perspective view of the load transfer and stabilization system of FIG. 9.

FIGS. 9 and 10 show additional aspects of the combined hip belt 16 and roll control apparatus 20 as shown in FIGS. 1–6. A pair of straps 60, 62 may be secured at attachment locations 28, 30 so that they can be, in turn, secured to shoulder straps 14 (FIG. 1). Alternatively, or in combination with straps 60, 62, fastening locations 72, 74 (FIG. 10) may be utilized to attach the combined hip belt 16/roll control rod apparatus 20 to a main compartment of a backpack (not shown in FIGS. 9 and 10).

The frame sheet or lumbar plate 45 (FIGS. 3, 9, and 10) is preferably covered by a fabric material 64 about its periphery to prevent the relatively rough edges of the high density polyethylene from cutting other portions of the backpack and perhaps the clothes of the person wearing the pack. A pair of pockets 66, 68 (FIG. 9) are sewn into the lumbar plate 45 to provide insertion locations for the vertical stays 42, 44. To ensure that the lumbar plate 45 does not articulate too much away from the hip belt 16 at pivot points 28, 30, a limit strap 70 (FIG. 9) may be adjustably mounted between the hip belt 16 and the lumbar plate 45. It should be noted that FIG. 10 shows the lumbar plate 45 being folded or bent beyond what is normally intended for purposes of illustrating the back side of lumbar plate 45. As mentioned, strap mounting locations 72, 74 (FIG. 10) are provided so that the main pack 12 (FIG. 1) can be further secured to the hip belt via the lumbar plate 45.

Figure 11:
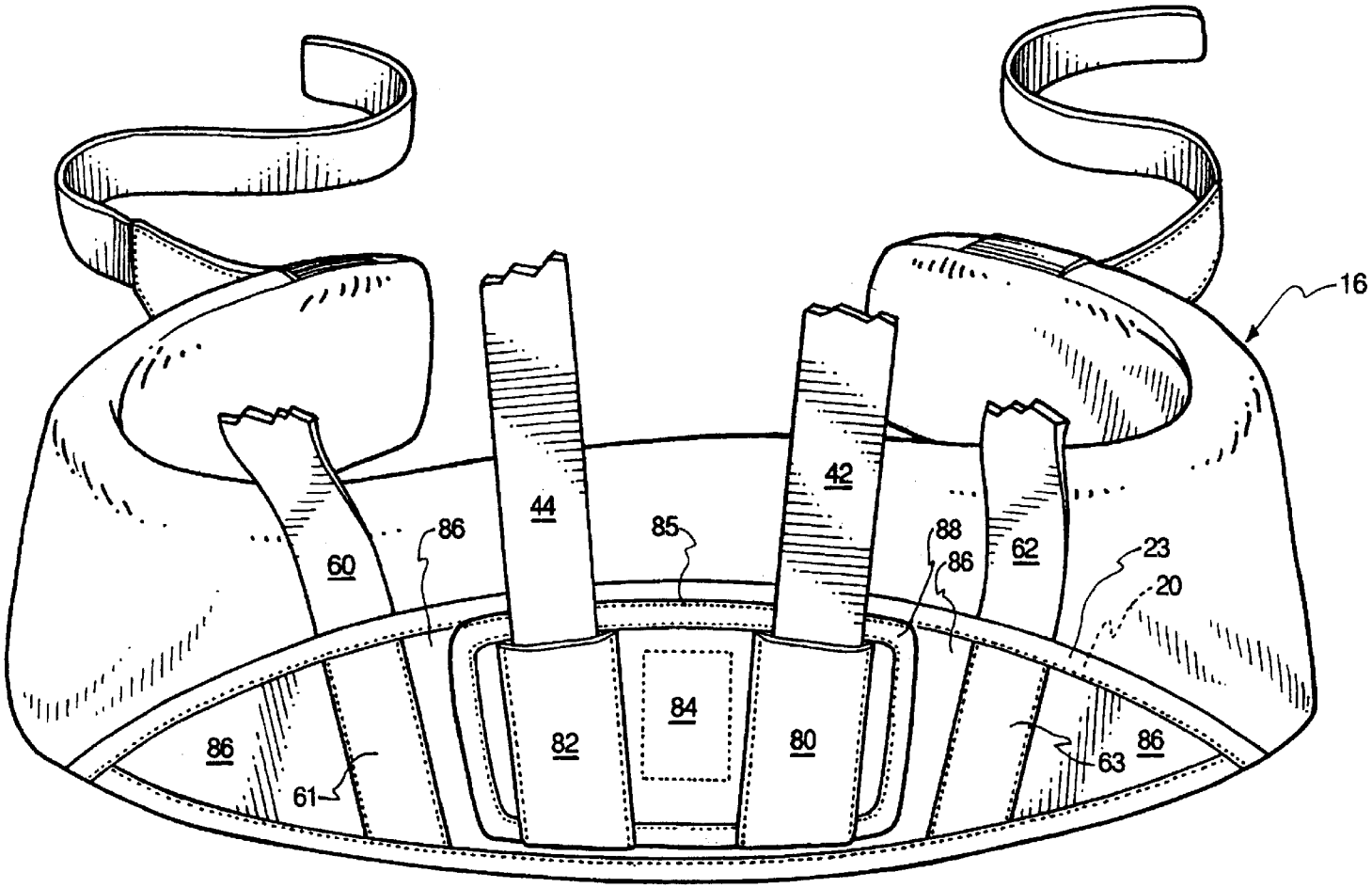
FIG. 11 is a front view of an alternative embodiment of a load transfer and stabilization system incorporated into a hip belt for backpacks according to the present invention.

FIG. 11 shows an alternative embodiment to the present invention. Rather than mounting locations 28, 30 as utilized in connection with the embodiments shown in FIGS. 1–10, the vertical stays 42, 44 are held inside of pockets 80, 82 sewn to a lumbar plate 84 which is sewn, in turn, into a fabric panel 86 along a single line of stitching 85 which runs along the entire length of lumbar plate 84 immediately below roll control rod 20. Thus, the lumbar plate 84 is capable of articulating relative to panel 86 about stitching line 85. The frame sheet or lumbar plate 84 includes a peripheral piece of fabric 88 which is utilized to cover the edges of the lumbar plate 84. The combined lumbar plate and peripheral fabric piece 88 are sewn into panel 86, as mentioned, along sewing or stitching line 85 to hold the entire assembly together. Much like the roll control apparatus 20 shown in FIGS. 1–10, the roll control apparatus shown in FIG. 11 will operate to stabilize the load and compensate for the rise and fall of the hips of the person wearing the backpack. The action of load transfer and stabilization will take place along stitching line 85. To ensure the appropriate dynamics, the lumbar plate 84 is sewn to the bottom of the material covering the roll control rod 20 so that the benefits of the roll control rod 20 can be achieved.

Figure 12:
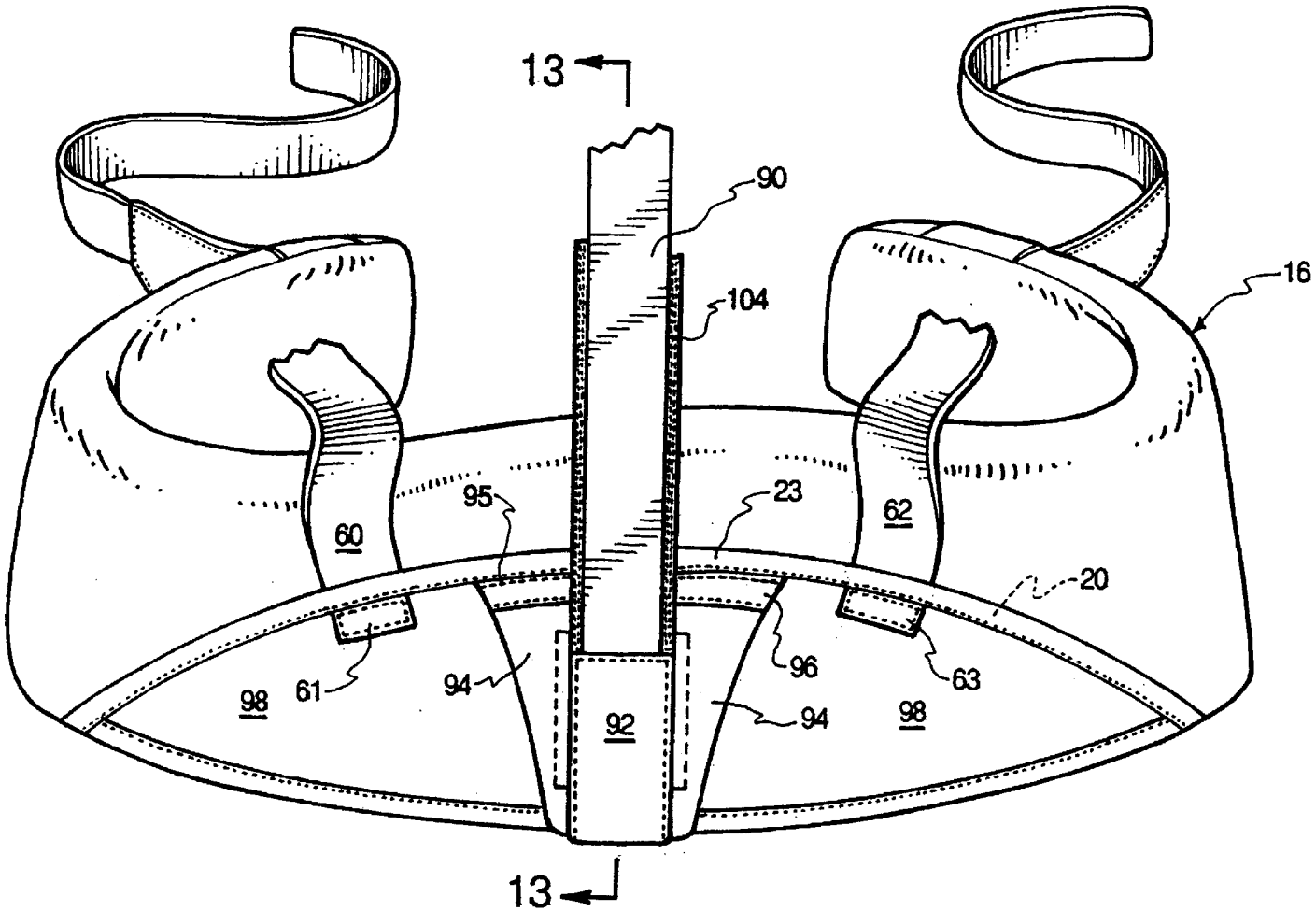
FIG. 12 is a front view of yet another alternative embodiment of a load transfer and stabilization system incorporated into a hip belt for a backpack according to the present invention.

Still another embodiment of the present invention is shown in FIG. 12. A single vertical stay 90 is inserted into a pocket 92 sewn into a uniquely configured frame sheet or lumbar plate 94. The lumbar plate 94, similar to lumbar plate 45 shown in FIG. 3 and lumbar plate 84 shown in FIG. 11, is comprised of high density polyethylene. Lumbar plate 94 is narrow toward the bottom and gradually increases in width until it connects with the roll control rod 20. A fabric edge cover piece 96 is sewn directly to the cover 23 encapsulating roll control rod 20 along stitching line 95. The top edge of lumbar plate 94 and the bottom of roll control rod 20 are adjacent to and engaged with one another to provide substantially the same benefits associated with the roll control rod 20 shown and comprised with respect to FIGS. 1–9. Straps 60, 62 may be connected, in turn, to shoulder straps 14 (FIG. 1), which are sewn to a panel 98 at locations 61, 63. Panel 98 also provides a location for securing roll control rod 20.

Figure 13:
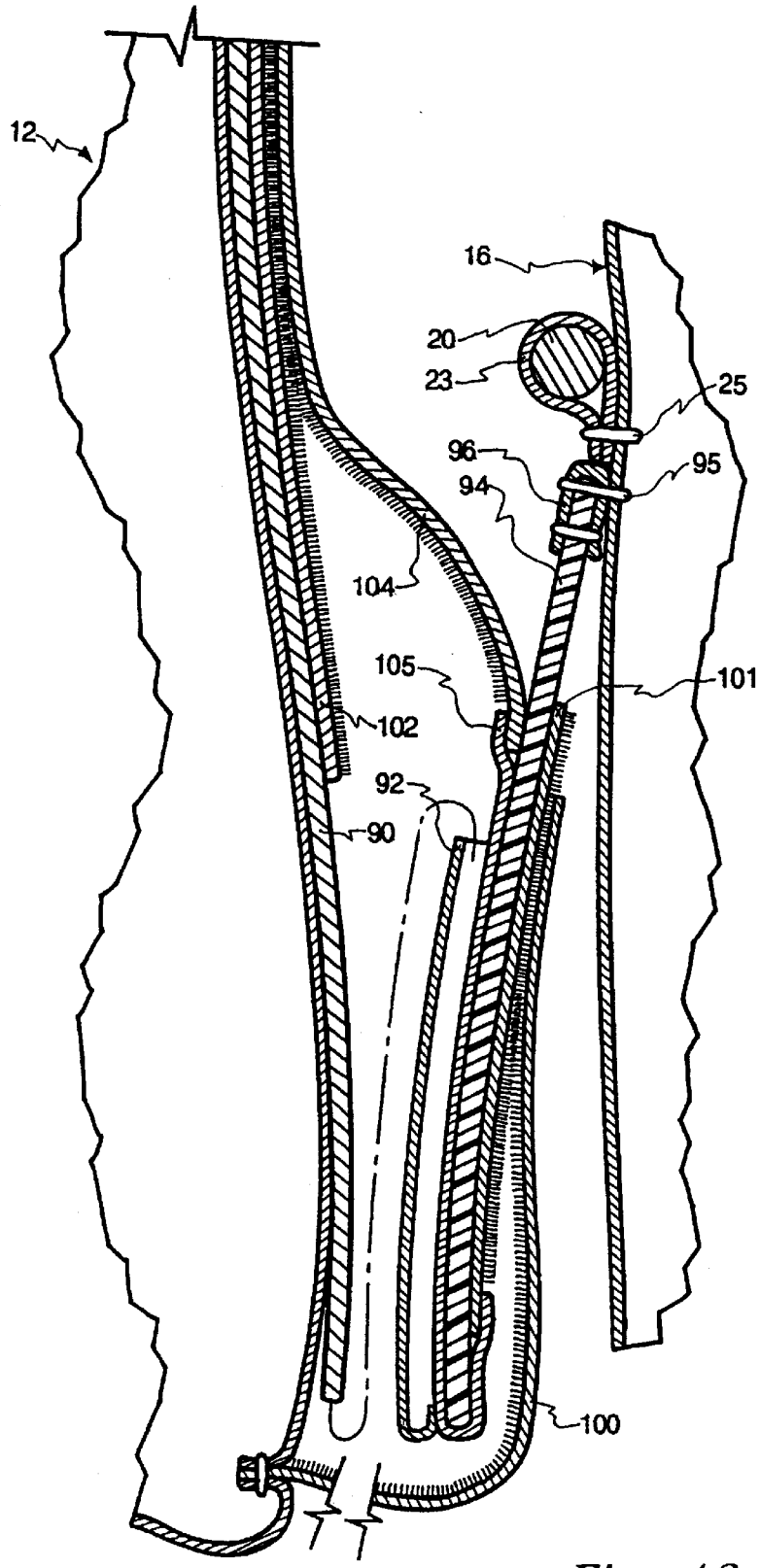
FIG. 13 is a sectional view, taken along the line 13—13 of FIG. 12, showing the various interconnecting elements between the load transfer and stabilization system and the hip belt for a backpack.

FIG. 13 shows a sectional view of the roll control apparatus of FIG. 12. The roll control rod 20 and its enveloping fabric 23 are secured to the hip belt 16 at stitching location 25. The lumbar plate 94 is attached to the hip belt 16 through fabric edge piece 96 at a single stitching line or location 95. Thus, lumbar plate 94 articulates relative to hip belt 16 at stitch line 95. This forms a flap-type of mounting arrangement. The main compartment 12 of the backpack is secured to the frame sheet 94 by means of an attachment flap 100 which includes a Velcro-type fastener and is secured, in turn, to a section of fabric 101 with a corresponding Velcro-type fastener. Fabric piece 101 is secured to the back side of lumbar plate 94. In addition, stay 90 is inserted into a pocket 92 which will hold a substantial portion of the weight of the main compartment 12 of the backpack. To further secure the pack in place, a piece of fabric 102 with a Velcro-type fastening mechanism is secured to the backside of stay 90 so that it can be secured, in turn, to a piece of fabric 104 with a Velcro-type fastening mechanism. Fabric piece 104 is secured to the lumbar plate by means of a piece of fabric 105, as shown in FIG. 13. As shown in FIG. 12, the top edge of lumbar plate 94 is secured adjacent to and engaged with the roll control rod 20 so that the load transfer and stabilization benefits can be achieved, similar to what has been described with respect to the other embodiments of the present invention.

While this invention has been described with reference to certain specific embodiments and examples, it will be recognized by those skilled in the art that many variations are possible without departing from the scope and spirit of this invention. The invention, as described by the claims, is intended to cover all changes and modifications of the invention which do not depart from the spirit of the invention. The words "including" and "having," as used in the specification, including the claims, shall have the same meaning as the word "comprising."

What is claimed is:

1. A backpack load transfer and stabilization system, comprising:

a backpack;

a hip belt assembly, including a hip belt, coupled to the backpack at two rotational mounting locations, the hip belt to be secured around a person's waist;

a roll control apparatus integrally formed within the hip belt assembly having a roll control rod with two terminal rod ends;

two opposing flanged extensions integrally formed within the hip belt assembly and rotationally coupled to the hip belt at the rotational mounting locations; and the interaction of the roll control apparatus, the opposing flanged extensions, and the backpack allowing the extensions to interactively rotate in concert with the roll control apparatus while simultaneously transferring the backpack load toward the ends of the hip belt.

2. A backpack load transfer and stabilization system according to claim 1, further comprising a lumbar plate attached beneath the roll control rod.

3. A backpack load transfer and stabilization system according to claim 1 wherein the stabilizer arcs upwardly to form an apex in close proximity to an upper edge of the hip belt.

4. A backpack load transfer and stabilization system according to claim 1 wherein the hip belt includes an upper edge, and wherein the stabilizer arcs upwardly to form an apex in close proximity to the upper edge of the hip belt and the ends of the stabilizer terminate below a middle line of the hip belt.

5. A backpack load transfer and stabilization system according to claim 1 wherein the opposing flange extensions are rotationally coupled to the hip belt at the rotational mounting locations by bolts inserted through grommets formed within the extensions.

6. A backpack load transfer and stabilization system according to claim 1 wherein each of the two terminal rod ends are attached to the corresponding flanged extensions, the distance between the two terminal rod end attachment locations being greater than the distance of the two respective rotational mounting locations to create pivotal moment arms; the roll control apparatus stabilizing the backpack while limiting the relative rotation of each extension.

7. A backpack load transfer and stabilization system according to claim 1, further comprising a horizontal cross bar to interconnect the hip belt with the cargo compartment of the backpack.

8. A backpack load transfer and stabilization system according to claim 7, further comprising the horizontal cross bar coupled to vertically oriented, V-shaped stays thus completing a frame for the backpack.

9. A backpack load transfer and stabilization system according to claim 1 wherein the extensions provide the only interface between the hip belt and the backpack.

10. A backpack load transfer and stabilization system according to claim 1 wherein the roll control rod is configured to have a generally circular cross section.

11. A load transfer and stabilization system for a backpack hip belt, comprising:

a hip belt for a backpack, the hip belt having a width, a height, and a pair of ends;

a rod attached to the hip belt, the rod having opposed ends, the rod extending across a major portion of the width of the hip belt;

pair of extension members secured to the ends of the rod, the extension members having attachment locations for securing the backpack to the hip belt, the extension members transferring the load toward the ends of the hip belt, the rod interconnecting the extension members such that when a person carrying the backpack walks, the rod compensates for movement of the person's hips to minimize any side-to-side sway of the backpack.

12. A backpack load transfer and stabilization system according to claim 11 wherein the rod is contained entirely within the hip belt.

13. A backpack load transfer and stabilization system according to claim 11 wherein the rod arcs upwardly to form an apex in close proximity to an upper edge of the hip belt.

14. A backpack load transfer and stabilization system according to claim 11 wherein the hip belt includes an upper edge, and wherein the rod arcs upwardly to form an apex in close proximity to the upper edge of the hip belt and the ends of the rod terminate below a middle line of the hip belt.

15. A backpack load transfer and stabilization system according to claim 11 wherein the hip belt includes opposed ends and an upper edge, and wherein the rod arcs upwardly to form an apex in close proximity to an upper edge of the hip belt, the apex of the rod moving relative to the hip belt while a person walks carrying the backpack.

16. A backpack load transfer and stabilization system according to claim 11 wherein the hip belt includes opposed ends and an upper edge, and wherein the rod arcs upwardly to form an apex in close proximity to an upper edge of the hip belt, the apex of the rod moving relative to the hip belt to stabilize a backpack load with respect to side-to-side motion while a person walks carrying the backpack.

17. A backpack load transfer and stabilization system according to claim 11 wherein the extension members provide the only interface between the hip belt and the backpack.

18. A backpack load transfer and stabilization system according to claim 11 wherein the extension sections including mounting locations for rotatably securing the extension sections and attached hip belt to the backpack.

19. A backpack load transfer and stabilization system according to claim 11 wherein the rod comprises generally a circular cross section.

20. A backpack load transfer and stabilization system, comprising:

a backpack cargo compartment;

a hip belt secured to the cargo compartment;

a pair of attachments locations for connecting the backpack to the hip belt, the attachment locations allowing rotation of the hip belt relative to the backpack;

a pair of extension members extending from the respective attachment locations to transfer weight toward end locations on the hip belt;

a flexible, resilient rod interconnecting the cantilevered members to stabilize the backpack cargo compartment from side-to-side movement when a backpacker hauls the backpack.

* * * * *